US009814332B2

(12) United States Patent
Zimmerman

(10) Patent No.: US 9,814,332 B2
(45) Date of Patent: Nov. 14, 2017

(54) ANCHORING DEVICE WITH DIRECTIONAL RELEASE AND ATTACHMENT CAPABILITY AND PROTECTION AGAINST INADVERTENT RELEASE

(71) Applicant: Israel Harry Zimmerman, Los Angeles, CA (US)

(72) Inventor: Israel Harry Zimmerman, Los Angeles, CA (US)

( * ) Notice: Subject to any disclaimer, the term of this patent is extended or adjusted under 35 U.S.C. 154(b) by 249 days.

(21) Appl. No.: 14/754,121

(22) Filed: Jun. 29, 2015

(65) Prior Publication Data

US 2016/0376065 A1 Dec. 29, 2016

(51) Int. Cl.
*B65D 25/24* (2006.01)
*A47G 19/10* (2006.01)

(52) U.S. Cl.
CPC ..... *A47G 19/10* (2013.01)

(58) Field of Classification Search
CPC .... B65D 25/24; B65D 2313/06; A47G 19/08; A47G 23/03; A47G 19/10; B65G 49/061; F16B 47/00; A47K 1/09
USPC ..... 220/628
See application file for complete search history.

(56) References Cited

U.S. PATENT DOCUMENTS 1,518,943 A 12/1924 Story
1,753,611 A 4/1930 Lower
1,778,175 A 10/1930 Thune
1,840,400 A 1/1932 Lebherz
2,083,299 A 6/1937 Hunter
2,233,870 A 3/1941 Muter
2,542,400 A * 2/1951 Donofrio ..... A47G 19/10 248/362
2,565,793 A 8/1951 Weismantel
2,601,279 A 6/1952 Hacus
2,740,545 A 9/1956 Bates
2,782,948 A 2/1957 Steinberg
2,839,260 A 6/1958 Jacobi, Jr.
2,895,636 A 7/1959 Martin
2,908,473 A 10/1959 Snyder
(Continued)

FOREIGN PATENT DOCUMENTS

DE 3742636 1/1989
EP 1649788 4/2006
(Continued)

*Primary Examiner* — Jeffrey Allen
(74) *Attorney, Agent, or Firm* — Walter W. Duft

(57) ABSTRACT

An anchoring device having directional release and attachment capability includes a lower base member and an upper movable member. The movable member is wholly or partially nested within the base member and movable relative thereto. The movable member includes a gripping region not covered by the base member for intentional manipulation and lifting of the movable member. A seal member is configured to engage an external reference surface and form a substantially airtight seal therewith that defines a controlled pressure zone between the seal member and the reference surface. A communication port can be opened and closed via actuation of the movable member to selectively vent or isolate the controlled pressure zone. A protective member covers one or more areas of the movable member not covered by the base member and not part of the gripping region in order to prevent unwanted venting of the communication port.

20 Claims, 5 Drawing Sheets

(56) References Cited

U.S. PATENT DOCUMENTS

| | | | |
|---|---|---|---|
| 2,910,264 | A | 10/1959 | Lindenberger |
| 2,932,119 | A | 4/1960 | Borah |
| 2,936,139 | A | 5/1960 | Lindstrom |
| 2,963,256 | A | 12/1960 | Borah |
| 2,968,888 | A | 1/1961 | Borah |
| 3,094,235 | A | 6/1963 | Lunning |
| 3,159,370 | A | 12/1964 | Rubinstein |
| 3,383,001 | A | 5/1968 | Wei |
| 3,675,886 | A | 7/1972 | Kampmier |
| 3,847,324 | A | 11/1974 | Uchanski et al. |
| 4,040,549 | A | 8/1977 | Sadler |
| 4,127,211 | A | 11/1978 | Zerbey |
| 4,133,575 | A | 1/1979 | Mader |
| 4,137,356 | A | 1/1979 | Shoemaker et al. |
| 4,726,553 | A | 2/1988 | Wischusen, III |
| 4,756,497 | A | 7/1988 | Lan |
| 4,759,525 | A | 7/1988 | Cross et al. |
| 4,760,987 | A | 8/1988 | Lan |
| 4,836,488 | A | 6/1989 | Ross |
| 4,872,721 | A | 10/1989 | Sniadach |
| 4,890,760 | A | 1/1990 | Nicoll, Sr. et al. |
| 4,928,848 | A | 5/1990 | Ballway |
| 4,940,138 | A | 7/1990 | Hornstein |
| 4,941,635 | A | 7/1990 | Lan |
| 4,955,493 | A | 9/1990 | Touzani |
| 4,978,566 | A | 12/1990 | Scheurer et al. |
| 5,040,719 | A | 8/1991 | Ballway |
| 5,065,973 | A | 11/1991 | Wang |
| 5,071,096 | A | 12/1991 | Hartman et al. |
| 5,076,527 | A | 12/1991 | Yung-Huei |
| 5,133,524 | A | 7/1992 | Liu |
| 5,180,132 | A | 1/1993 | Pearson et al. |
| 5,186,350 | A | 2/1993 | McBride |
| 5,192,043 | A | 3/1993 | Fa |
| 5,207,076 | A | 5/1993 | Sciarrillo |
| 5,273,182 | A | 12/1993 | Laybourne |
| 5,282,541 | A | 2/1994 | Chen |
| 5,292,140 | A | 3/1994 | Laing |
| D357,170 | S | 4/1995 | Wellsfry |
| 5,413,302 | A | 5/1995 | Ferster |
| 5,511,752 | A | 4/1996 | Trethewey |
| 5,531,353 | A | 7/1996 | Ward et al. |
| 5,667,180 | A | 9/1997 | Duckworth |
| 5,742,971 | A | 4/1998 | Salinger |
| D397,915 | S | 9/1998 | McNaughton |
| D400,763 | S | 11/1998 | Taylor et al. |
| 5,992,806 | A | 11/1999 | Adams |
| 6,000,575 | A | 12/1999 | LaCour et al. |
| 6,039,206 | A | 3/2000 | DeFrancesco |
| 6,059,138 | A | 5/2000 | Labruyere |
| D439,116 | S | 3/2001 | White |
| 6,264,054 | B1 | 7/2001 | Miyake et al. |
| 6,315,153 | B1 | 11/2001 | Osborn |
| 6,318,683 | B1 | 11/2001 | Savoy |
| 6,367,652 | B1 | 4/2002 | Toida et al. |
| 6,439,418 | B1 | 8/2002 | Immerman et al. |
| 6,491,265 | B2 | 12/2002 | Tracy |
| 6,497,394 | B1 | 12/2002 | Dunchock |
| 6,511,031 | B2 | 1/2003 | Lin |
| 6,520,368 | B1 | 2/2003 | Chiu |
| 6,543,637 | B1 | 4/2003 | Osborn |
| 6,571,976 | B1 | 6/2003 | Sonnabend |
| 6,596,374 | B1 | 7/2003 | Adjeleian |
| 6,666,420 | B1 | 12/2003 | Carnevali |
| 6,745,987 | B2 | 6/2004 | Rousselet et al. |
| 6,776,368 | B1 | 8/2004 | Duncan et al. |
| 6,895,642 | B2 | 5/2005 | Huang |
| 7,090,183 | B2 | 8/2006 | Heybl et al. |
| 7,201,285 | B2 | 4/2007 | Beggins |
| 7,306,113 | B2 | 12/2007 | El-Saden et al. |
| 7,458,541 | B1 | 12/2008 | Chang |
| 7,481,329 | B2 | 1/2009 | Camp, Jr. |
| 7,726,715 | B2 | 6/2010 | Nagasawa et al. |
| 8,025,169 | B2 | 9/2011 | Zimmerman |
| 8,028,850 | B2 | 10/2011 | Zimmerman |
| 8,272,523 | B1 * | 9/2012 | DeMusis, Sr. ..... A47L 23/00 215/393 |
| 8,757,418 | B2 | 6/2014 | Zimmerman |
| 2002/0130133 | A1 | 9/2002 | Immerman et al. |
| 2003/0075666 | A1 * | 4/2003 | Dunchock ..... A47G 19/10 248/682 |
| 2003/0102320 | A1 | 6/2003 | Park |
| 2004/0238541 | A1 | 12/2004 | Camp, Jr. |
| 2004/0238542 | A1 | 12/2004 | Camp, Jr. et al. |
| 2006/0175506 | A1 | 8/2006 | Lan |
| 2007/0012706 | A1 | 1/2007 | Deadman |
| 2007/0205205 | A1 | 9/2007 | Kliewer |
| 2008/0093370 | A1 | 4/2008 | Darsey |
| 2008/0190948 | A1 | 8/2008 | Sayasithsena |
| 2009/0250467 | A1 | 10/2009 | Schmidt |
| 2009/0256043 | A1 | 10/2009 | Lan |
| 2014/0326630 | A1 * | 11/2014 | Henry ..... A47G 19/02 206/503 |
| 2015/0230638 | A1 * | 8/2015 | Jagger ..... F16B 47/006 220/574 |
| 2015/0342382 | A1 * | 12/2015 | D'Alesio ..... A47G 23/0225 220/739 |

FOREIGN PATENT DOCUMENTS

| | | |
|---|---|---|
| JP | 2003501315 | 1/2003 |
| JP | 2004160079 | 10/2004 |
| JP | 2006314739 | 11/2006 |
| WO | WO2012008942 | 1/2012 |

* cited by examiner

ANCHORING DEVICE WITH DIRECTIONAL RELEASE AND ATTACHMENT CAPABILITY AND PROTECTION AGAINST INADVERTENT RELEASE

BACKGROUND

1. Field

The present disclosure relates to anchoring devices adapted for directional release from and attachment to a surface, including devices for holding liquid or solid contents, or for holding a separate article that is mounted on the device.

2. Description of the Prior Art

By way of background, there are various known devices designed for directional release from and attachment to a surface. These devices operate by opening and closing a communication port to selectively vent or isolate a controlled pressure zone under a seal member that sits on a flat non-porous reference surface. Typically, there is a fixed member that carries the seal member, and a movable member that is operably connected to the communication port. The movable member is arranged to open the communication port when lifted, either immediately or after it moves a predetermined distance.

A device of this type has the ability to remain affixed to a reference surface except when the movable member is manipulated using a defined lifting movement that causes the communication port to open and vent the controlled pressure zone. In that case, the device can be removed from the reference surface without discernible resistance, and may thereafter be returned to its original rest position with no unusual manipulation being required for re-seating. External forces that do not cause the communication port to open, such as side loads, tend to increase the gripping force by reducing the pressure within the controlled pressure zone, such that detachment from the reference surface is resisted.

The present disclosure is directed to an improvement in anchoring devices having directional release and attachment capability. In particular, applications are envisioned for such devices wherein it may be possible to release the device inadvertently without performing the defined lifting movement. An infant's food bowl would be one example. In that case, it may be possible for a baby to grab the food bowl with an uncoordinated grip that accidentally actuates the movable member, thereby opening communication port and inadvertently releasing the bowl. The improvements described herein limit the susceptibility of such devices to inadvertent release.

SUMMARY

An anchoring device is proposed having directional release and attachment capability, and which further includes a feature that prevents inadvertent release. In example embodiments, the anchoring device may include a lower base member and an upper movable member. The movable member is wholly or partially nested within the base member by virtue of the base member having a sidewall portion that surrounds at least part of a sidewall portion of the movable member, but leaves at least a top surface portion of the movable member exposed, the movable member being movable relative to the base member. The movable member includes a gripping region that is not covered by the base member and which is provided for intentional manipulation and lifting of the movable member. A seal member on the base member may be configured to engage an external reference surface and form a substantially airtight seal therewith that defines a periphery of a controlled pressure zone between the seal member and the reference surface. A communication port may be provided that can be opened and closed via actuation of the movable member to selectively vent or isolate the controlled pressure zone. A protective member may be provided to cover one or more areas of the exposed top surface portion of the movable member that are not covered by the base member and not part of the intended gripping region, but which are prone to being manipulated either intentionally or unintentionally to actuate the movable member in an unwanted manner. The protective member prevents unwanted venting of the communication port due to a user interacting with the one or more areas of the exposed top surface portion of the movable member instead of the intended gripping region.

BRIEF DESCRIPTION OF THE DRAWINGS

The foregoing and other features and advantages will be apparent from the following more particular description of example embodiments, as illustrated in the accompanying Drawings, in which.

DETAILED DESCRIPTION OF EXAMPLE EMBODIMENTS

Figure 1:
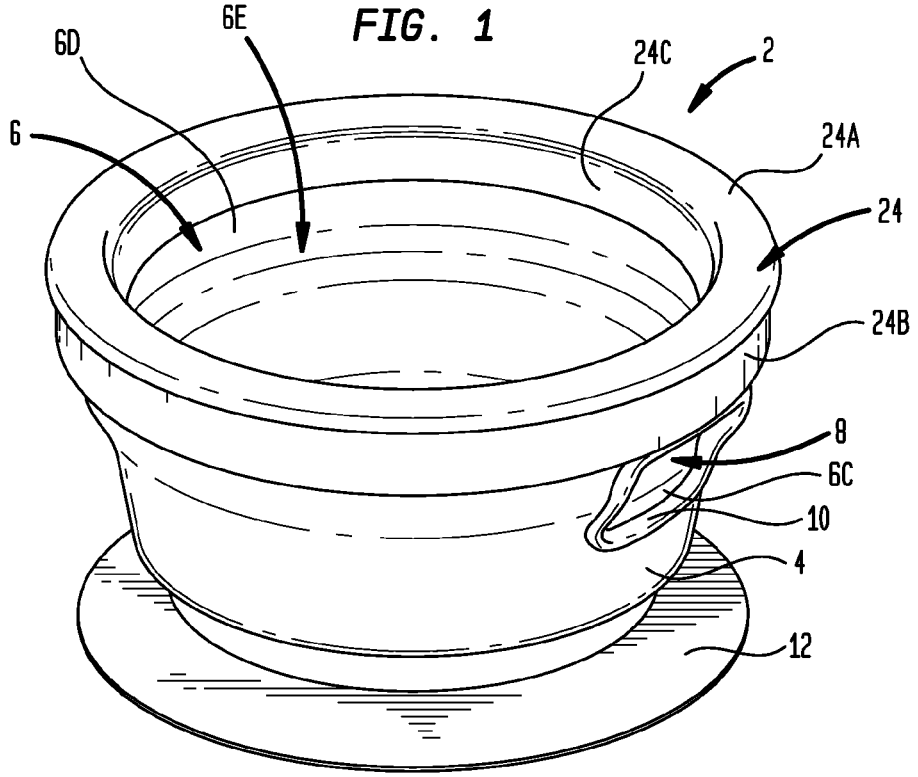
FIG. 1 is a perspective view showing a first example embodiment of an anchoring device that may be constructed in accordance with the present disclosure.
Figure 2:
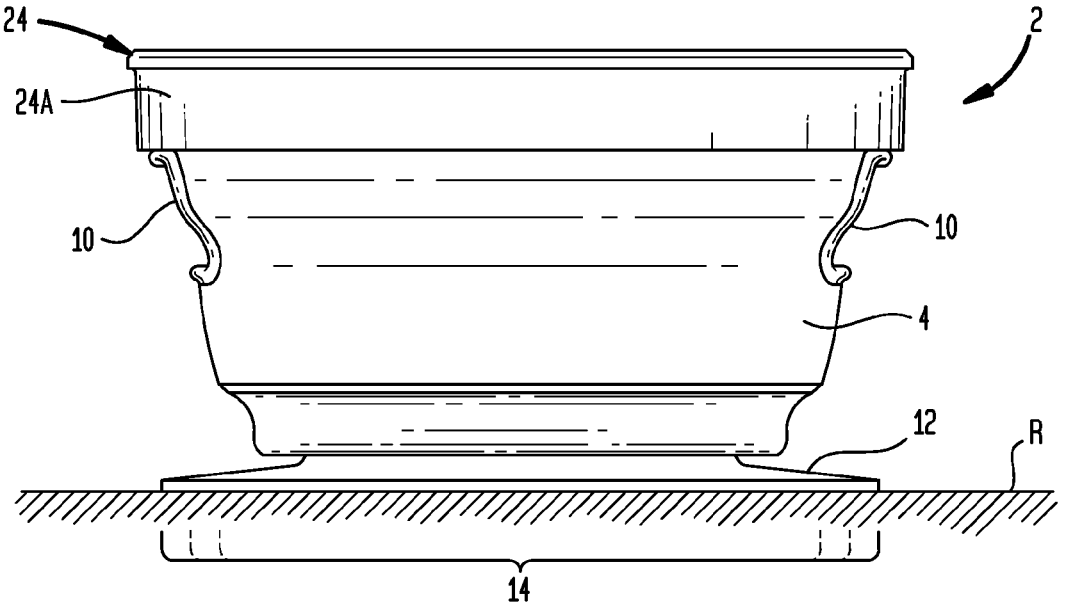
FIG. 2 is a side elevation view of the anchoring device of FIG. 1.

Turning now to the drawing figures, in which like reference numbers illustrate like structure in all of the several views, FIGS. 1-4 illustrate an example anchoring device 2 having directional release and attachment capability, and which further includes a feature that prevents inadvertent release. The anchoring device 2 may include a lower base member 4 and an upper movable member 6 that is movable up and down relative to the base member.

Figure 4:
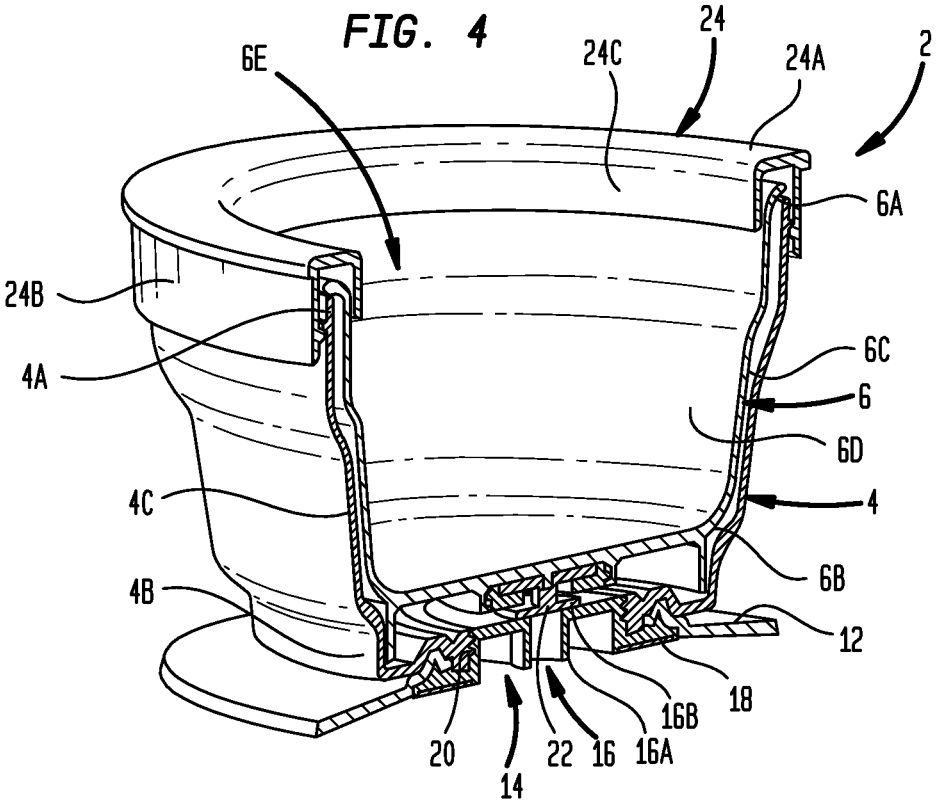
FIG. 4 is a cross-sectional perspective view of the anchoring device of FIG. 1.

As best shown in FIG. 4, the base member 4 may be configured with an upper end 4A, a lower end 4B, and a medial sidewall portion 4C extending between the upper and lower ends. The upper end 4A of the base member 4 may be open.

With continued reference to FIG. 4, the movable member 6 may be configured with an upper end 6A, a lower end 6B, and a medial sidewall portion 6C extending between the upper and lower ends. The upper end 6A of the movable member 6 may be open and the lower end 6B may be closed. This allows the movable member 6 to be implemented as a vessel in which the upper end 6A defines a rim, and the lower end 6B and medial sidewall portion 6C define a concave structure having an inner surface 6D adapted to hold a solid or liquid material. Collectively, the upper end 6A and the inner surface 6D may be referred to as the top surface portion 6E of the movable member 6. In the illustrated embodiment of FIGS. 1-4, the movable member 6 is configured as a bowl or a cup, such that the top surface portion 6E is concave. It should of course be understood that implementing the movable member 6 as a vessel is but one possible embodiment of the disclosed subject matter. Other embodiments may be constructed for other end use applications. One such alternative embodiment is a holding device, as described below in connection with FIGS. 8 and 9, in which the top surface portion 6E of the movable member 6 is flat (or convex).

It will be seen that the lower end 4B and medial sidewall portion 4C of the base member 4 define a concave space that receives the movable member 6. The movable member 6 is nested within the base member 4 by virtue of the base member's medial sidewall portion 4C surrounding the outside of at least a portion of the movable member's medial sidewall portion 6C. The base member may thereby serve as a movable member holding structure. In the illustrated embodiment of FIGS. 1-4, the respective medial sidewall portions 4C and 6C of the base member 4 and the movable member 6 extend to substantially the same height, such that the respective upper ends 4A and 6A of the base member and the movable member are substantially co-located. The base member 4 covers the entire outer surface of the movable member's medial sidewall portion 6C. However, the base member medial sidewall portion 4C does not cover the upper end 6A or the inner surface 6C of the movable member 6, such that the entire top surface portion 6E of the movable member is left exposed. In other embodiments (not shown) the medial sidewall portion 4C of the base member 4 may not extend to the full height of the medial sidewall portion 6C of the movable member, such that the base member's upper end 4A sits below the movable member's upper end 6A. In that case, not only would the top surface portion 6E of the movable member 6 be exposed, but also the portion of the outer surface of the medial sidewall portion 6C that is not covered by the base member's medial sidewall portion 4C.

Figure 3:
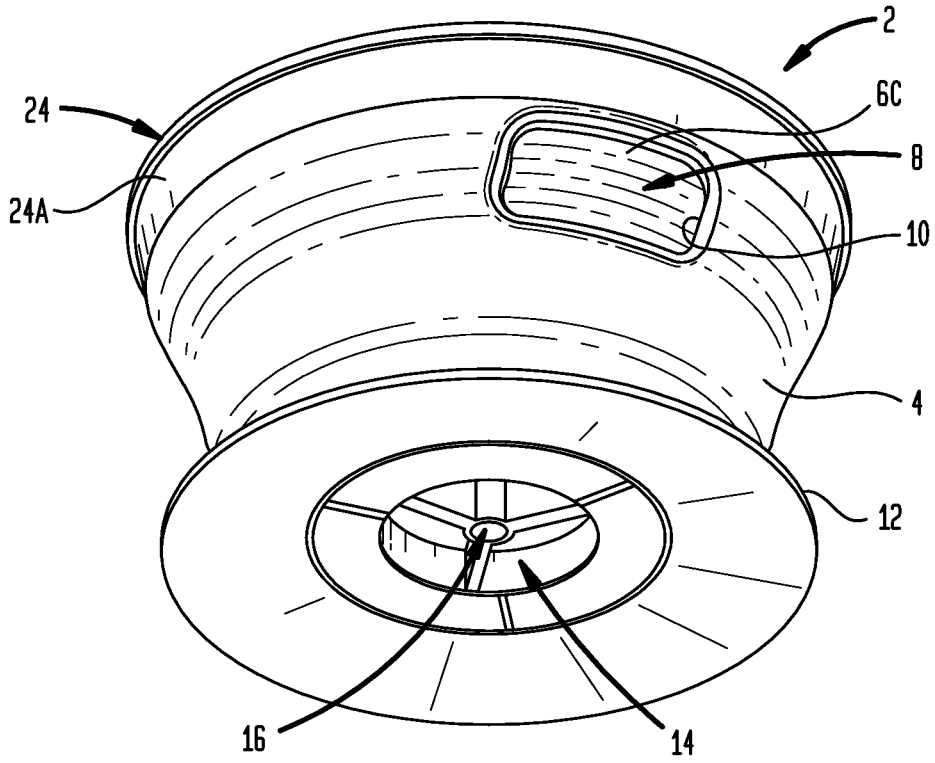
FIG. 3 is a bottom perspective view of the anchoring device of FIG. 1.

As best shown in FIGS. 1 and 3, the movable member 6 may include a defined gripping region 8 that is not covered by the base member 4 and which is provided for intentional manipulation and lifting of the movable member. In the illustrated embodiment of FIGS. 1-4, the gripping region 8 is an exposed area on the outer surface of the medial sidewall portion 6C that defines part of the movable member's vessel-shaped configuration. The gripping region 8 is made accessible to a user through one or more access openings 10 formed in the medial sidewall portion 4C of the base member 4. By way of example only, the illustrated embodiment of FIGS. 1-4 shows two such access openings 10.

A flexible seal member 12 may be provided at the lower end 6B of the base member 4. The seal member 12 is configured to engage an external reference surface R (see FIG. 2) and form a substantially airtight seal therewith that defines the periphery of a controlled pressure zone 14 (see FIG. 2) between the seal member and the reference surface. The controlled pressure zone 14 represents an air space between the seal member 12 and the reference surface R that is bounded by a peripheral region where the bottom of the seal member 12 interfacially contacts the top of the reference surface.

As best shown in FIGS. 3 and 4, a communication port 16 may be provided that can be opened and closed via actuation of the movable member 6 to selectively vent or isolate the controlled pressure zone 14. As can be seen in FIG. 4, the communication port 16 may include a vent opening 16A and a vent blocker 16B. The vent opening 16A and the vent blocker 16B may be arranged for movement relative to each other during movement of the movable member 6. In the illustrated embodiment of FIGS. 1-4, the anchoring device 2 is designed so that the vent opening 16A and the vent blocker 1B undergo substantially instantaneous separation from each other whenever the movable member 6 moves upwardly relative to the base member 6. In an alternative embodiment (not shown) the anchoring device 2 could be designed so that the vent opening 16A and the vent blocker 16B separate only after the movable member 6 has moved upwardly a predetermined distance relative to the base member 4.

The vent opening 16A may be provided on the base member 4 and the vent blocker 16B may be provided on the movable member 6. In the illustrated embodiment of FIGS. 1-4, the vent opening 16A is formed in a seal retainer 18 that threads into a threaded opening 20 formed at the lower end 4B of the base member 4. The seal retainer 18 is used to attach the seal 12 to the base member 4. The vent blocker 16B is mounted to the lower end 6B of the movable member 6. To facilitate efficient sealing of the controlled pressure zone 14, the communication port 16 may include a resilient element that provides a deformable sealing member 22 between the vent opening 16A and the vent blocker 16B. In the illustrated embodiment of FIGS. 1-4, the sealing member 22 is on the vent blocker 16B attached to the movable member 6. In an alternative embodiment (not shown), the sealing member could be provided on the seal retainer 18 that defines the vent opening 16A.

If an attempt is made to lift or rock the anchoring device 2 by applying an external vertical or lateral force while the communication port 16 is closed, the volume of the air space within the controlled pressure zone 14 will start to increase. This will in turn decrease the air pressure within the controlled pressure zone 14 relative to the ambient air pressure outside the controlled pressure zone. As a result, the anchoring device 6 will adhere to the reference surface R. The adhering force will increase in correspondence with the decreasing air pressure within the controlled pressure zone, which in turn is inversely proportional to the increased volume therein caused by deformation of the seal member 12 in response to the applied external force. This is the same design principle implemented by various self-anchoring beverage container embodiments disclosed in commonly-owned U.S. Pat. Nos. 8,025,169 and 8,028,850. The contents of these patents are each hereby incorporated by reference as if fully set forth herein.

It will be appreciated that the location where the peripheral region of interfacial contact is formed between the seal member 12 and the reference surface R, and thus the footprint of the controlled pressure zone 14, is variable. This is indicated by the dashed lines used in FIG. 2 to illustrate the estimated footprint of the controlled pressure zone 14. The exact size of the controlled pressure zone 14 at any given moment will depend on several factors, including the shape and stiffness of the seal member 12, and the magnitude/direction of any applied external forces.

A different result is obtained if the anchoring device 2 is manipulated in a manner that results in the movable member 6 being lifted relative to the base member 4. As noted above, this manipulation may be performed by a user engaging the gripping region 8 of the movable member. In that case, the communication port 16 will open, the controlled pressure zone 14 will vent to atmosphere, and the anchoring device 2 will lift without discernible resistance (apart from the weight of the device) off the reference surface R. As soon as the anchoring device 2 is returned to the reference surface R and the movable member 6 is released, the communication port 16 will close and the anchoring device will be "re-armed" to resist unwanted detachment from the reference surface R.

In order to minimize the likelihood of inadvertent actuation of the movable member 6, a protective member 24 may be provided that covers one or more areas of the exposed top surface portion 6E of the movable member 6 that are not covered by the base member 4 and not part of the gripping region 8, but which are prone to being manipulated either intentionally or unintentionally to actuate the movable member in an unwanted manner. In the illustrated embodiment of FIGS. 1-4 wherein the anchoring device 2 is embodied as a vessel, it is envisioned that the one or more areas most susceptible to inadvertent manipulation will include the movable member's upper end 6A as well as the upper portion of its inner surface 6D. These are the areas that are most likely to be grasped in an unintended manner when removing solid or liquid material held by the vessel, such as food, or by attempting to lift the anchoring device 2 in lieu of grasping the defined gripping region 8.

To prevent unwanted manipulation of the susceptible areas mentioned above, the protective member 24 may be configured as a protector ring that includes a top portion 24A, an outer ring portion 24B, and an inner ring portion 24C. The top portion 24A extends transversely over the respective upper ends 4A and 6A of the base member 4 and the movable member 6. The outer ring portion 24B extends downwardly from the outside edge of the top portion 24A. It can be fixedly mounted to the outside wall of the base member's upper end 4A, as by threading. Alternatively, the protective member 24 could be slidably mounted to the base member 4, or as described in more detail below in connection with FIGS. 7A and 7B, to the movable member 6. The inner ring portion 24C extends downwardly from the top portion 24A to form a protective inner wall. Its length is chosen to cover a desired portion of the inner surface 6D of the movable member 6. The portion of the movable member's inner surface 6D that is covered by the inner ring portion 24C may thus include the upper end 6A and some or all of the medial sidewall portion 6C, on the inside thereof, down to a desired depth within the vessel defined by the movable member.

Figure 5:
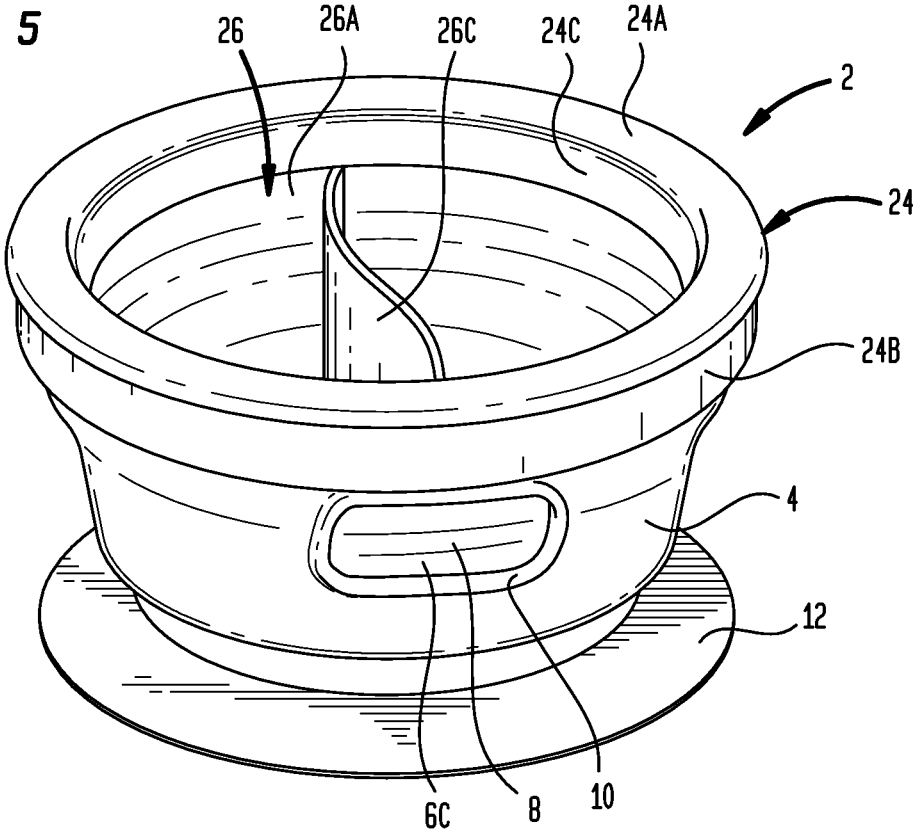
FIG. 5 is a top perspective view of the anchoring device of FIG. 1, with a removable insert added thereto.
Figure 6:
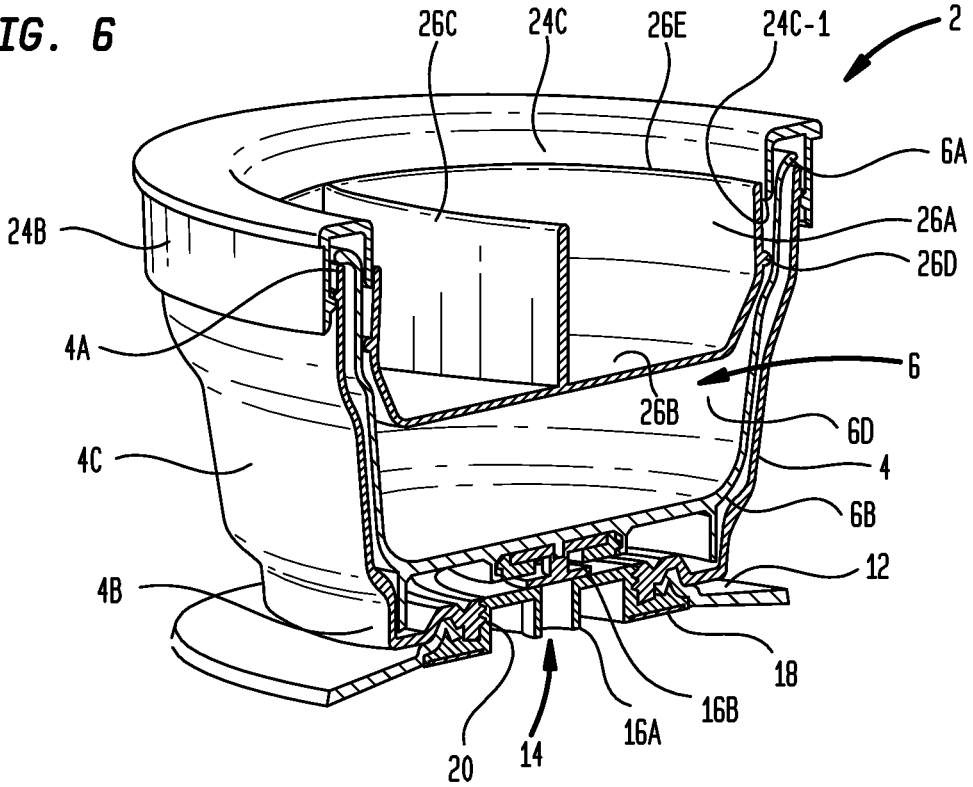
FIG. 6 is a cross-sectional perspective view of the anchoring device of FIG. 1, with the auxiliary insert of FIG. 5 added thereto.

It should be noted that the protective member 24 could also cover the portion of the inner surface 6D that is formed by the bottom portion 6B of the movable member 6. This is shown in the embodiment of FIGS. 5-6 described in more detail below. In such an embodiment, the protective member 24 itself could serve as a vessel or holding structure for holding a solid or liquid material. The movable member 6 would then no longer be needed as a holding structure, and its main purpose would be to open and close the communication port 16 when its gripping region 8 is manipulated. The shape of the movable member 6 could be reconfigured accordingly.

As previously mentioned, the purpose of the protective member 24 is to prevent unwanted venting of the communication port 16 due to a user interacting with the one or more areas of the exposed top surface portion 6E of the movable member 6 that are not covered by the base member 6, instead of interacting with the movable member's gripping region 8, which is the intended mode of use of the anchoring device. As also noted above, the one or more areas of the exposed top surface portion 6E of the movable member 6 that are not covered and protected by the protective member 24 may include the rim at the upper end portion 6A of the movable member 6, and at least the upper portion of the inner surface 6D, neither of which is covered by the base member 4, and neither of which constitutes part of the gripping region 8. These exposed surface areas are respectively covered and protected by the protective member's top and inner ring portions 24A and 24C.

Turning now to FIGS. 5 and 6, the protection afforded by the protective member 24 could be augmented by placing a removable insert 26 on the movable member 6 to serve as a wall blocker that blocks access to the entirety of the movable member's inner surface 6D. In the illustrated embodiment of FIGS. 5-6, wherein the movable member 6 is embodied as a vessel, the insert 26 may be embodied as a vessel liner. In this embodiment, the insert 26 may be configured with a liner sidewall 26A and a liner bottom 26B, so as to form a tray. A divider wall 26C may be optionally provided to sub-divide the tray into compartments that hold different materials.

The liner sidewall 26A rests on, and blocks, the inner surface 6D of the movable member 6. To minimize the area of contact between these two structures, a circumferential bead 26D may be provided on the outside of the liner sidewall 26A. The circumferential bead 26D may be designed so that it is the only portion of the insert 26 to engage the movable member 6. As shown in FIG. 6, the upper end 26E of the insert 26 may extend above the lower edge 24C-1 of the protector member's inner ring 24C, along the inside wall of thereof. The insert 26 blocks access to the movable member's inner surface 6D. Should the insert 26 happen to be grasped during use of the anchoring device 2, no lifting forces will be transferred to the movable member 6. Instead, the insert 26 will simply lift up and the circumferential bead 26D will disengage from movable member's inner surface 6D.

In the illustrated embodiment of FIGS. 5-6, the removable insert 26 acts as an extension of the protective member 24, and thus may be considered part of the protective member itself. Indeed, the removable insert 26 could be merged with the protective member 24 as a single integrated structure. In an alternative embodiment (not shown), the removable insert 26 could be used alone as the sole protective structure representing the protective member 24, without any upper ring portion.

In both the illustrated embodiment of FIGS. 1-4, and that of FIGS. 5-6, the outer ring portion 24B of the protective member 24 extends downwardly to cover the outside wall of the base member's upper end 4A, to which it is attached. Preferably, the protective member's outer ring portion 24B should not extend so far as to block the access openings 10 or otherwise interfere with access to the gripping region 8 of the movable member 8.

Because the protective member 24 also covers the top portion 6A of the movable member 6, it will retain the movable member so that it cannot be separated from the anchoring device 2, provided that the protective member 24 is mounted (fixedly or slidably) to the base member 4.

However, as mentioned above, the protective member 24 could be slidably mounted to the movable member 6, such as by way of a slotted interconnection.

Figure 7A:
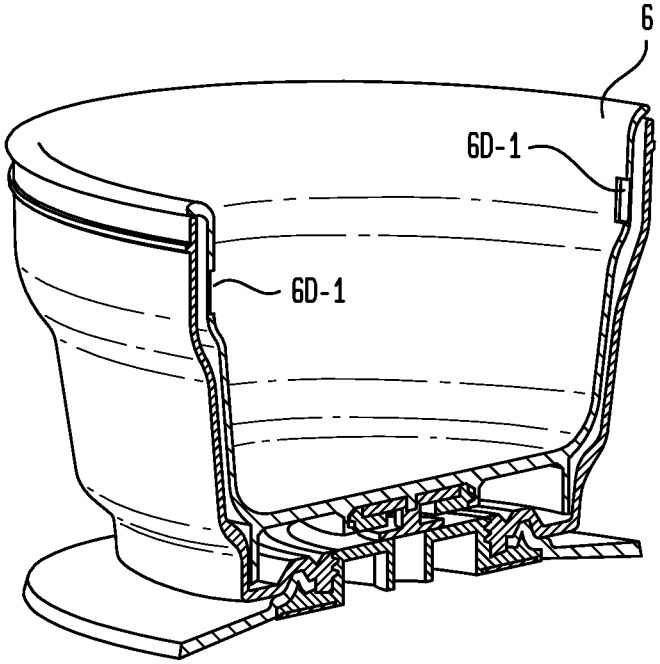
FIG. 7A is a cross-sectional perspective view showing a first modified component of the anchoring device of FIG. 1.
Figure 7B:
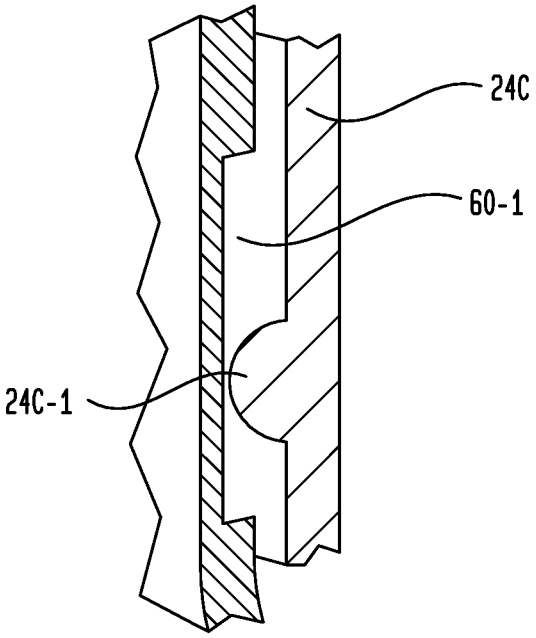
FIG. 7B is an enlarged cross-sectional view showing a second modified component of the anchoring device of FIG. 1 that interacts with the first modified component of FIG. 7A.

This alternative configuration is illustrated in FIGS. 7A and 7B. FIG. 7A shows the movable member 6 with a pair of slot-shaped indents 6D-1 formed on the movable member's inner surface 6D. As shown in FIG. 7B, the slot indents 6D-1 are configured to receive corresponding detents 24C-1 formed on the opposing wall of the protective member's inner ring portion 24C. This allows the protective member 24 to slide relative to the movable member 6 in a manner that allows the protective member to move a defined distance without displacing the movable member. The defined distance corresponds to the length of the indents 6D-1. Only if the detents 24C-1 engage the upper end of the slot indents 6D-1 will the protective member 24 start to displace the movable member 6. Insofar as the protective member 24 is now retained on the anchoring device 2 by way of the slotted interconnection, the outer ring 24B is no longer required, although it could be provided if desired.

According to the configuration of FIGS. 7A and 7B, the protective member 24 could serve as an alternative gripping region to be manipulated for lifting the movable member 6, either in addition to or in lieu of the gripping region 8 on the movable member itself. In that case, the protective member 24 still prevents inadvertent venting of the communication port if the protective member is grasped and even lifted, so long as it is not lifted the requisite distance needed for the detents 24C-1 to engage the upper ends of the slot indents 6D-1. Although not shown, a similar indent/detent arrangement may be used to slidably retain the movable member 6 on the base member 4.

Figure 8:
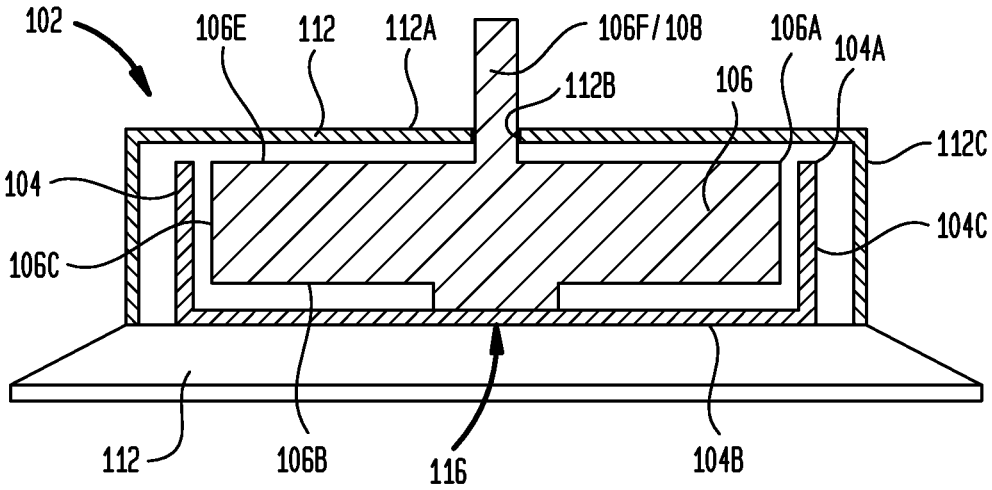
FIG. 8 is a diagrammatic view showing a second example embodiment of an anchoring device that may be constructed in accordance with the present disclosure.

Turning now to FIG. 8, a different type of anchoring device 102 is shown in order to illustrate an alternative embodiment of the disclosed subject matter. The anchoring device 102 may include a base member 104, a movable member 106, a flexible seal 112, and a communication port 116 that is opened and closed by manipulating the movable member upwardly and downwardly. The base member 104 may be configured with an upper end 104A, a lower end 104B, and a medial sidewall portion 104C extending between the upper and lower ends. The movable member 6 may be configured with an upper end 106A, a lower end 106B, and a medial sidewall portion 106C extending between the upper and lower ends.

Unlike the anchoring device 102, the movable member 106 is not configured as a vessel, but instead has a non-concave upper surface portion 106E that is flat (but which could also be convex if desired). The movable member 106 also has a mounting structure 106F adapted for attachment to a separate article (not shown) to be removably held by the anchoring device 102 on a reference surface. The mounting structure 106F serves as a gripping region 108 of the movable member 106 insofar as the intended manner of lifting the movable member is by grasping the separate article that is attached to the mounting structure. In the illustrated embodiment of FIG. 8, the mounting structure 106F is configured as an elongated stem or the like to which the separate article may be mounted. When the separate article is attached to the mounting structure 106F, it will be releasable from the reference surface by lifting it in a prescribed upward manner, but will resist release if an unwanted side force is applied thereto.

The movable member 106 nests within the base member 104. A protective member 112 may be provided to prevent inadvertent opening of communication port 110 by virtue of a lifting force being applied to one or more areas of the exposed top surface portion 106E of the movable member 106 that are not covered by the base member 104. In this case, the entire top surface portion 106E of the movable member 106, apart from the mounting structure 106F, is an area that a user is likely to interact with in an unwanted matter to manipulate and lift the movable member, absent the protective member 112. This area does not represent part of the intended gripping region of the movable member 106. In the illustrated embodiment, the protective member 112 has an upper portion 112A that covers the movable member 106 except for the mounting structure 106F. The protective member's upper portion 112A may be formed with an aperture 112B through which the mounting structure 106F protrudes. The protective member 112 may also include a medial sidewall portion 112C that may extend around and envelope the outside of the base member 104.

Figure 9:
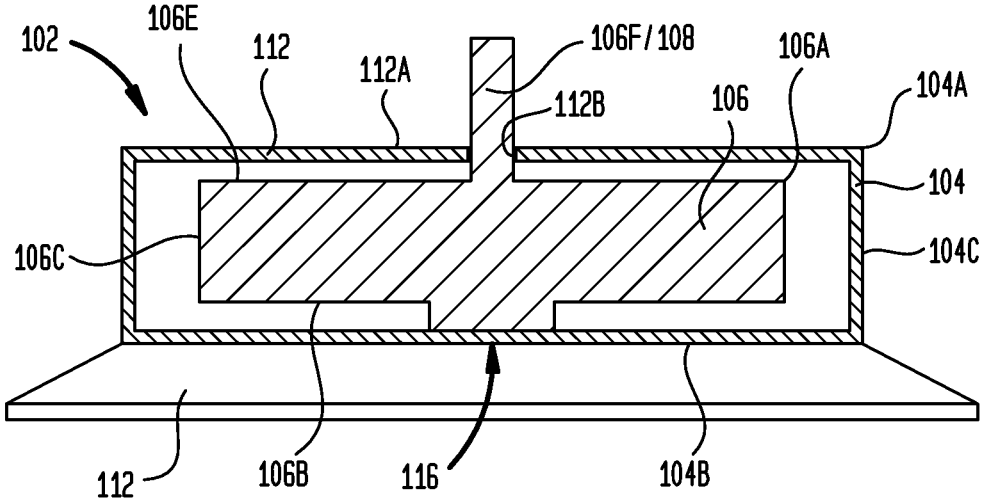
FIG. 9 is a diagrammatic view showing a modification of the anchoring device of FIG. 8.

Alternatively, as shown in FIG. 9, the protective member 112 could be formed without the medial sidewall portion 112C, or only a very short variation thereof. In either case, the periphery of the protective member's upper portion 112A (or a very short variation of the medial sidewall portion 112C) could be fixedly mounted to the upper end 104A of the base member 104. The protective member 112 could also be slidably mounted to the movable member 106, such that the protective member would have to move upwardly a prescribed distance before lifting the movable member 106 and opening the communication port 110.

Although the protective member 112 may be mounted to the base member 104 as a separate structure that is distinct from the base member, the protective member 112 could also be integrally formed as an extension of the base member 104. In that case, the base member 104 and the protective member 112 would represent an integrated base/protective member 104/112, with the demarcation point between the two structures possibly being the top portion 104A of the base member.

In the embodiments of FIGS. 8 and 9, a seal retainer (not shown) may be provided that mounts to the bottom of the base member 104 in order to retain the seal 112. If the base member 104 and the protective member 112 are formed as a single integral structure, assembly of the movable member 106 into the anchoring device 102 can be facilitated by making the seal retainer removable, and wide enough so that when it is removed, the movable member 106 can be introduced into the space defined by the base member 104. Alternatively, if the base member 104 and the protective structure 112 are detachably connected, the movable member 106 may be introduced into the space defined by the base member by removing the protective member. In that case the seal retainer need not be removable from the base member 104, although this may be desirable to facilitate seal replacement.

Accordingly, an anchoring device having directional release and attachment capability and which further includes a feature that prevents inadvertent release has been disclosed. Although example embodiments have been shown and described, it should be apparent that many variations and alternative embodiments could be implemented in accordance with the present disclosure. It is understood, therefore, that the invention is not to be in any way limited except in accordance with the spirit of the appended claims and their equivalents.

What is claimed is:

1. An anchoring device having directional release and attachment capability, and further including a feature that prevents inadvertent release, comprising:

a lower base member;

an upper movable member that is wholly or partially nested within said base member by virtue of said base member having a sidewall portion that surrounds at least part of a sidewall portion of said movable member but leaves a top surface portion of said movable member exposed;

said movable member being movable relative to said base member;

said movable member including a gripping region that is not covered by said base member and which is provided for intentional manipulation and lifting of said movable member;

a seal member on said base member, said seal member being configured to engage an external reference surface and form a substantially airtight seal therewith that defines a periphery of a controlled pressure zone between said seal member and said reference surface;

a communication port that can be opened and closed via actuation of said movable member to selectively vent or isolate said controlled pressure zone; and a protective member covering one or more areas of said exposed top surface portion of said movable member that are not covered by said base member and not part of said intended gripping region, but which are prone to being manipulated either intentionally or unintentionally to actuate said movable member in an unwanted manner;

said protective member preventing unwanted venting of said communication port due to a user interacting with said one or more areas of said exposed top surface portion of said movable member instead of said intended gripping region.

2. The apparatus of claim 1, wherein said protective member is mounted to said base member as a separate structure that is distinct from said base member, or is integral with said base member.

3. The apparatus of claim 1, wherein said protective member comprises an insert member that removably rests on said movable member.

4. The apparatus of claim 1, wherein said protective member is slidably mounted to said movable member in a manner that allows said protective member to move a defined distance without displacing said movable member, and thereafter displace said movable member after said protective member has moved said defined distance.

5. The apparatus of claim 1, wherein said movable member comprises a vessel having a rim and an inner surface adapted to hold a solid or liquid material, said rim and said inner surface not being part of said gripping region, and said protective member covering said rim and at least an upper portion of said inner surface.

6. The apparatus of claim 5, wherein said vessel is a bowl or a cup.

7. The apparatus of claim 5, wherein said gripping region of said movable member comprises an outer surface of said vessel that is not covered by said protective member.

8. The apparatus of claim 7, wherein said base member comprises at one or more openings that allow access to said outer surface of said vessel.

9. The apparatus of claim 1, wherein said gripping region of said movable member comprises a mounting structure adapted for attachment to a separate article to be held by said anchoring device, said mounting structure comprising said gripping region.

10. The apparatus of claim 9, wherein said protective member covers said top surface portion of said movable member except for said mounting structure.

11. The apparatus of claim 10, wherein said mounting structure comprises an elongated stem that protrudes through an opening in said protective member.

12. The apparatus of claim 1, wherein said communication port comprises a vent opening and a vent blocker, said vent opening and said vent blocker being arranged for movement relative to each other during movement of said movable member.

13. The apparatus of claim 12, wherein said vent opening and said vent blocker are arranged for substantially instantaneous movement relative to each other whenever said movable member moves relative to said base member.

14. The apparatus of claim 12, wherein said vent opening is on said base member and said vent blocker is on said movable member.

15. The apparatus of claim 12, wherein said communication port further comprises a resilient element providing a deformable sealing member between said vent opening and said vent blocker.

16. The apparatus of claim 15, wherein said sealing member is on one of said base member and said movable member.

17. An anchoring device having directional release and attachment capability, and further including a feature that prevents inadvertent release, comprising:

a lower base member;

an upper movable member wholly or partially nested within said base member by virtue of said base member having a sidewall portion that surrounds at least part of a sidewall portion of said movable member but leaves a top surface portion of said movable member exposed;

said movable member being movable relative to said base member;

said movable member including a gripping region that is not covered by said base member and which is provided for intentional manipulation and lifting of said movable member;

a seal member on said base member, said seal member being configured to engage an external reference surface and form a substantially airtight seal therewith that defines a periphery of a controlled pressure zone between said seal member and said reference surface;

a communication port that can be opened and closed via actuation of said movable member to selectively vent or isolate said controlled pressure zone; and a protective member covering one or more areas of said exposed top surface portion of said movable member that are not covered by said base member and not part of said intended gripping region, but which are prone to being manipulated either intentionally or unintentionally to actuate said movable member in an unwanted manner;

said protective member preventing unwanted venting of said communication port due to a user interacting with said one or more areas of said exposed top surface portion of said movable member instead of said intended gripping region;

said protective member being carried by one or both of said base member and said movable member; and said protective member slidably engaging said movable member in manner that allows said protective member to be lifted a predefined distance without lifting said movable member, but thereafter lifting said movable member when said predetermined distance has been exceeded.

18. The apparatus of claim 17, wherein said protective member slidably engages said movable member by way of a slotted interconnection.

19. An anchoring device having directional release and attachment capability, and further including a feature that prevents inadvertent release, comprising:

a lower base member;

an upper movable member wholly or partially nested within said base member by virtue of said base member having a sidewall portion that surrounds at least part of a sidewall portion of said movable member but leaves a top surface portion of said movable member exposed;

said movable member being movable relative to said base member;

said movable member including a gripping region that is not covered by said base member and which is provided for intentional manipulation and lifting of said movable member;

a seal member on said base member, said seal member being configured to engage an external reference surface and form a substantially airtight seal therewith that defines a periphery of a controlled pressure zone between said seal member and said reference surface;

a communication port that can be opened and closed via actuation of said movable member to selectively vent or isolate said controlled pressure zone;

a protective member covering one or more areas of said top surface portion of said movable member that are not covered by said base member and not part of said gripping region, but which are prone to being manipulated either intentionally or unintentionally to actuate said movable member in an unwanted manner;

said protective member preventing unwanted venting of said communication port due to a user interacting with said one or more areas of said top surface portion of said movable member instead of said intended gripping region;

said protective member being carried by one or both of said base member and said movable member; and said movable member comprising a vessel having a rim and an inner surface adapted to hold a solid or liquid material, said rim and said inner surface not being part of said gripping region, and said protective member covering said rim and at least an upper portion of said inner surface.

20. The apparatus of claim 19, wherein said gripping region of said movable member comprises an outer surface of said vessel, and wherein said base member comprises at one or more openings that allow access to said outer surface of said vessel.

* * * * *